US006832559B2

(12) United States Patent
Allen

(10) Patent No.: US 6,832,559 B2
(45) Date of Patent: Dec. 21, 2004

(54) ROLLER RAIL CLAMP

(75) Inventor: John Phillip Allen, Rangewood (AU)

(73) Assignee: Queensland Rail, Brisbane (AU)

( * ) Notice: Subject to any disclaimer, the term of this patent is extended or adjusted under 35 U.S.C. 154(b) by 0 days.

(21) Appl. No.: 10/296,945

(22) PCT Filed: Jun. 14, 2001

(86) PCT No.: PCT/AU01/00702

§ 371 (c)(1),
(2), (4) Date: May 30, 2003

(87) PCT Pub. No.: WO01/96663

PCT Pub. Date: Dec. 20, 2001

(65) Prior Publication Data

US 2003/0177937 A1 Sep. 25, 2003

(51) Int. Cl.[7] ..... E01B 29/04
(52) U.S. Cl. ..... 104/7.1; 104/7.2
(58) Field of Search ..... 104/7.1, 7.2, 9, 104/8, 12, 17.1, 229, 17.2

(56) References Cited

U.S. PATENT DOCUMENTS

| | | | | |
|---|---|---|---|---|
| 4,046,079 A | | 9/1977 | Theurer | |
| 4,281,868 A | | 8/1981 | Lovitt | |
| 4,895,078 A | * | 1/1990 | Mancini | 104/8 |

FOREIGN PATENT DOCUMENTS

| | | | | |
|---|---|---|---|---|
| DD | 288299 | | 3/1991 | |
| DD | 288299 A | * | 3/1991 | E01B/29/04 |
| GB | 2083108 | | 3/1982 | |
| GB | 2083108 A | * | 3/1982 | E01B/27/17 |
| SU | 1093741 | | 5/1984 | |
| SU | 1093741 A | * | 5/1984 | E01B/29/04 |

* cited by examiner

*Primary Examiner*—Frantz F. Jules
(74) *Attorney, Agent, or Firm*—Hoffman, Wasson & Gitler, PC

(57) ABSTRACT

The invention provides roller rail clamp apparatus for use in lifting a rail for operations such as replacement of ballast or resurfacing of a railway. The apparatus comprises parallel pairs of spaced-apart lift roller assemblies mounted to a support for positioning a pair of clamping to a rail of the track, each the lift roller assembly comprising at least one pair of rollers, wherein each the roller of a roller pair rotates on an axis in an essentially vertical plane adjacent a rail and the rollers are on opposite sides of a rail when a lift roller assembly is clamped thereto with the head of the rail releasably retained upwardly of flanges at the lower ends of the rollers; means for adjustably connecting the apparatus to a carrier thereof; a lift mechanism for adjusting the vertical position of the support relative to the carrier of the apparatus; and a tilt mechanism for applying torque about a horizontal axis to linkage between members of a pair of lift roller assemblies.

20 Claims, 7 Drawing Sheets

ROLLER RAIL CLAMP

TECHNICAL FIELD

This invention relates to equipment used in railway maintenance. More particularly, the invention relates to equipment used for lifting a section of track. Specifically, the invention is concerned with equipment referred to in the art as a "rail clamp".

BACKGROUND ART

Railways generally consist of a track supported by a bed of crushed rock or gravel, this bed being referred to as "ballast" in the art. Most tracks comprise a pair of rails fixed to lateral members known as "sleepers" (or in some countries, "cross-ties"). Sleepers are formed from steel, timber or concrete.

There is often a need during railway construction or maintenance for lifting of the track. For example, replacement of ballast is simplified by lifting the track as a whole to allow access to the ballast. When new ballast has been placed on top of a section of track, the track has to be lifted up through the ballast so that it can be on top of the added ballast. Other instances where track lifting is required include tamping and lining operations for resurfacing of a railway. Track realignment often requires lifting of the track while replacement of sleepers may also require some degree of track lifting.

For the efficient execution of the procedures referred to in the preceding paragraph, the machinery is propelled or drawn along the railway at the highest possible speed consistent with quality, machine wear and tear, and safety requirements. The track lift point thus moves with the machinery. Special equipment is required for lifting under such circumstances, the most usual equipment employed being a "rail clamp".

There are two general categories of rail clamps—roller and non-roller. Roller clamps are able to move along the rail with out being disengaged, whereas the non-roller clamp must be opened (disengaged) before being moved. It will be appreciated that only roller rail clamps are suitable for use in conjunction with machinery designed to move along the railway during operation of the machine. Consequently, the clamps must be capable of holding the lifted section of track—which can have a down force of the order of 35 tonne—and in addition must be capable of moving along the track. This is achieved solely through the gripping of the heads of the rails by the clamps.

In moving along a section of track, roller rail clamps can be obstructed. This most frequently occurs through the clamp meeting a fishplate or excessive weld flashing at a junction between rail sections. If a roller rail clamp is not designed to traverse an obstruction, the rail gripped by a particular clamp can be released with the potential for release of the entire lifted section. Such a "derailing" of the lifted section can have serious consequences including damage to the track. In addition, the clamps per se can be damaged.

A limitation of known roller rail clamps is that they are either incapable of traversing obstructions on the rails or have a limited capacity to traverse obstructions whilst lifting. There is thus a need for a roller rail clamp that overcomes the foregoing limitations of existing roller rail clamps.

SUMMARY OF THE INVENTION

The object of the invention is to provide a roller rail clamp that overcomes the limitations referred to in the previous paragraph.

In a broad format, the invention provides roller rail clamp apparatus for use with track comprising a pair of parallel rails, said apparatus comprising:

parallel pairs of spaced-apart lift roller assemblies mounted to a support for positioning a pair for clamping to a rail of said track, each said lift roller assembly comprising at least one pair of rollers, wherein each said roller of a roller pair rotates on an axis in an essentially vertical plane adjacent a rail and said rollers are on opposite sides of a rail when a lift roller assembly is clamped thereto with the head of said rail releasably retained between said rollers;

means for adjustably connecting said apparatus to a carrier thereof;

a lift mechanism for adjusting the vertical position of said support relative to said carrier of said apparatus; and a tilt mechanism for applying torque about a horizontal axis to linkage between members of a pair of lift roller assemblies.

The principle embodied by the roller rail clamp apparatus defined in the preceding paragraph is that load bearing is transferred between lift roller assemblies when traversing an obstacle in the rails of the track to which the apparatus is clamped for lifting. This is achieved through applying torque to a member that links the lift roller assemblies of a pair, the torque being applied about a horizontal axis. Alteration of the slope of the assembly of parallel pairs of spaced-apart lift roller assemblies can result from this application of torque and hence the positions of the roller assemblies relative to the horizontal. This will be explained in more detail below but briefly, in a normal working position on open track, torque on the member linking the lift roller assemblies of a pair is such that the rear roller assemblies are bearing the track. Opening of the front rollers (momentarily) as they traverse an obstacle is sensed and after clearing the obstacle, the torque is reversed through the action of the tilt mechanism so as to confer load bearing on the front lift roller assemblies. This allows the rear assemblies to traverse the obstacle with momentary opening of the rollers. Closure of the rollers on passing the obstacle is sensed and by way of the tilt mechanism, load bearing reverts to the rear roller assemblies.

The roller rail clamp apparatus of the invention can be adapted for use with any machine where lifting of track for the operation of the machine is required. For example, the apparatus can be part of a machine for removal of ballast. In such an application, the apparatus is used to suspend the track above an under-wagon plough that excavates the ballast as the machine moves along the railway. Other applications of the apparatus of the invention include lifting of track through ballast newly applied over the top thereof, re-alignment of track, and undercutting of track. The apparatus can also be used to stabilise on track lifting equipment and mobile work platforms.

Particular features of the roller rail clamp apparatus will be detailed below as will optional features and preferments. Broadly, however, the apparatus can be connected to any suitable wagon or machine-frame. Usually, apparatus is mounted midway between the wheels of a wagon. However, the apparatus can also be mounted ahead of, behind, or anywhere between the wheels of a wagon. Furthermore, the apparatus can also be supported by an off track machine such as an excavator, crane or gantry.

The support for the pairs of lift roller assemblies advantageously comprises a longitudinal beam for each pair of assemblies, there thus being two beams in the apparatus that are about the same distance apart as the rails of the track. A crosspiece to which they are pivotally mounted to allow tilting of the beams typically links the beams. It will be appreciated however that the support can be any assembly of members that appropriately positions the lift roller assemblies for clamping to rails yet permits tilting of the pairs of assemblies.

The means for adjustably connecting the apparatus to the wagon or equipment carrying it can be any suitable means. For example, the connection means can be a series of vertical and horizontal slides, a drawbar or a push bar. In place of a drawbar, a parallelogram linkage can be used. In a preferred form of the apparatus in which the support for the lift roller assemblies comprises linked longitudinal beams, the connecting means is conveniently a drawbar pivotally linked to a wagon carrying the apparatus. This drawbar is advantageously pivotally connected to the crosspiece between the lifting beams so that lateral and some angular movement of the beams is permitted.

The distance between the lift roller assemblies of each pair is determined by the maximum length of the obstacle to be traversed and the intended maximum speed of the machine incorporating the rail clamp. That is, the distance between the assemblies must be sufficient to allow transfer of load bearing from the rear assemblies to the front assemblies in the time taken for the obstacle to pass therebetween. For example, for traversal of a 600 mm long fishplate at a speed of up to 5 to 10 km/hr, a minimum distance between the assemblies of a pair is about 2,000 mm. This is of course very dependant on the speed of response of the tilt mechanism and the load being lifted.

In a preferred embodiment, each lift roller assembly comprises two pairs of rollers. The pairs, when spaced apart within a range of 100 to 400 mm, allows traversal of a small obstacle such as a weld flashing without the need to transfer load bearing from one assembly to the other. That is, the trailing roller pair of a duplex assembly can carry the track on opening of the leading pair which closes sufficiently quickly to carry the track during opening of the trailing roller pair.

The rollers of the lift roller assemblies are advantageously of the non self-locking type and are forced open by the obstacle. The rollers move out and around the obstacle whilst full clamp force is maintained. There will be some momentary dynamic variation in clamp force as the rollers negotiate the obstacle. However, this is reduced to a minimum by judicious design that may include the use of appropriately sized, pressurised and located hydraulic accumulators in order to minimise the effect of the momentary dynamics on the net clamping force. The operation of the rollers will be explained in greater detail below.

Rollers are advantageously flanged at their distal ends. The flange lies beneath the head of a rail when a pair of rollers is clamped thereabout and can back-up the primary gripping of the head by the rim portion of rollers.

The lift and tilt mechanisms can be any suitable mechanisms known to those of skill in the art. For example, lifting and tilting can by way of pulleys, gears, motors or rams or combinations of these mechanisms. Preferably, hydraulic rams are used to effect lifting and tilting.

The range of vertical adjustment of the support for the lift roller assemblies is in most instances limited at its maximum by the height above the normal track level of the chassis of a wagon carrying the roller lift clamp apparatus and rail stress considerations. In general, an adjustment range of 100 mm below to 400 above the normal track level is adequate. However, the adjustment range will depend on a number of variables such as rail size, sleeper type, and the particular operation being undertaken.

Having broadly described the invention, a non-limiting example of a roller rail clamp will now be provided with reference to the accompanying drawings briefly described hereafter.

In the figures, the same item number is used for a feature included in more than one drawing. A particular drawing is not necessarily to the same scale as other drawings.

BEST MODE AND OTHER MODES OF CARRYING OUT THE INVENTION

Figure 1:
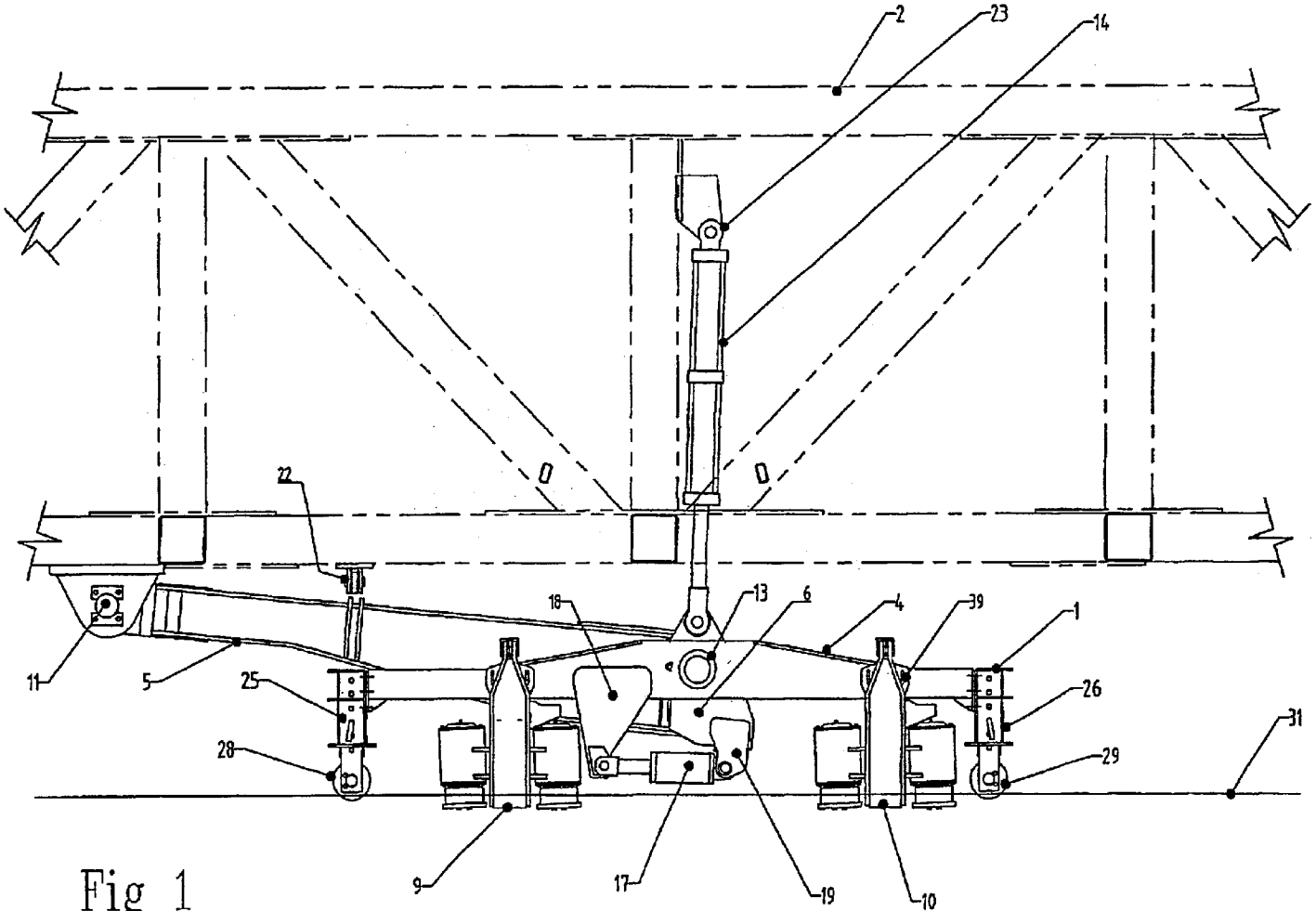
FIG. 1 is an elevational view of a roller rail clamp according to the invention.
Figure 2:
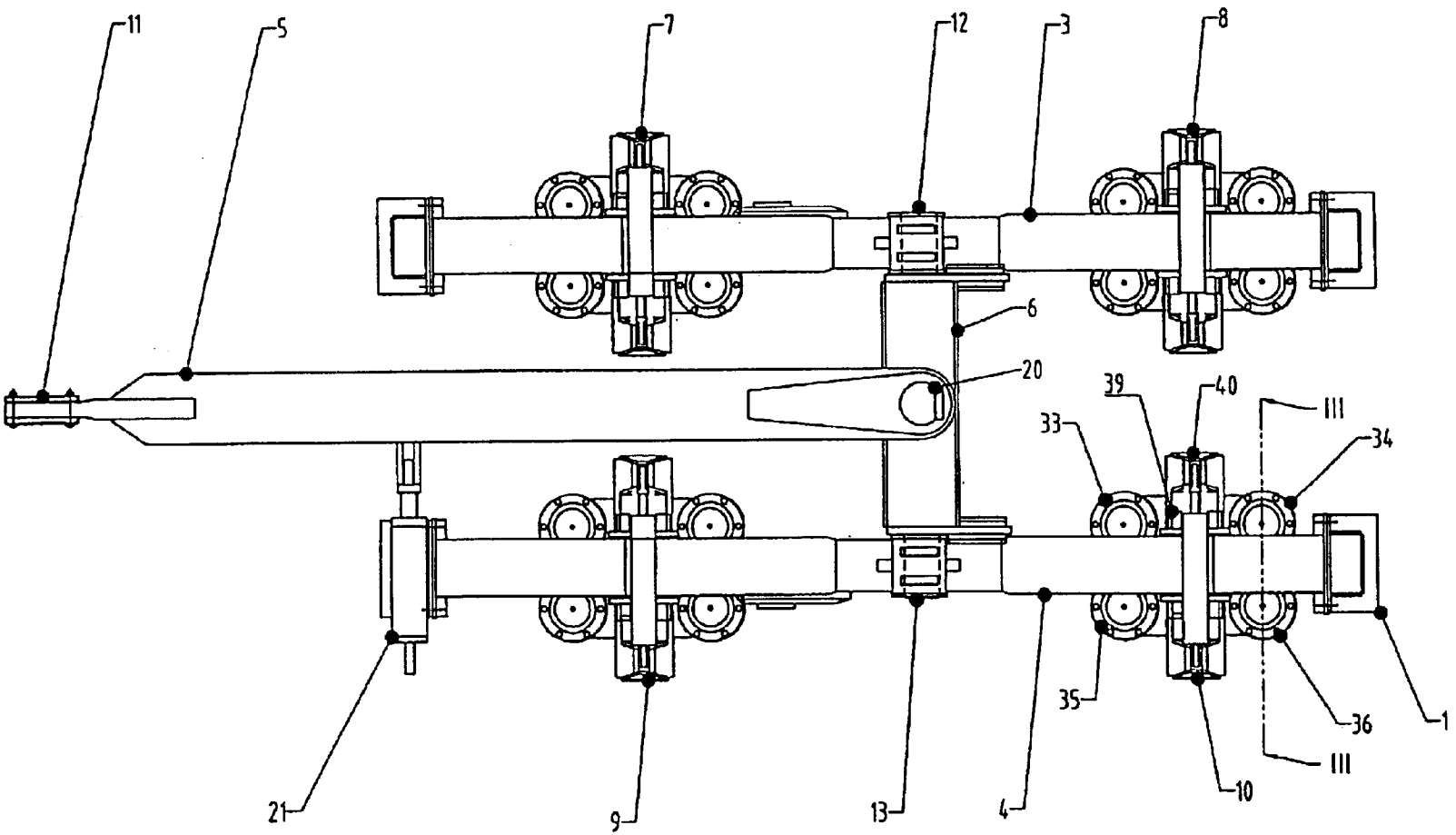
FIG. 2 is a plan view of the roller rail clamp shown in FIG. 1.
Figure 3:
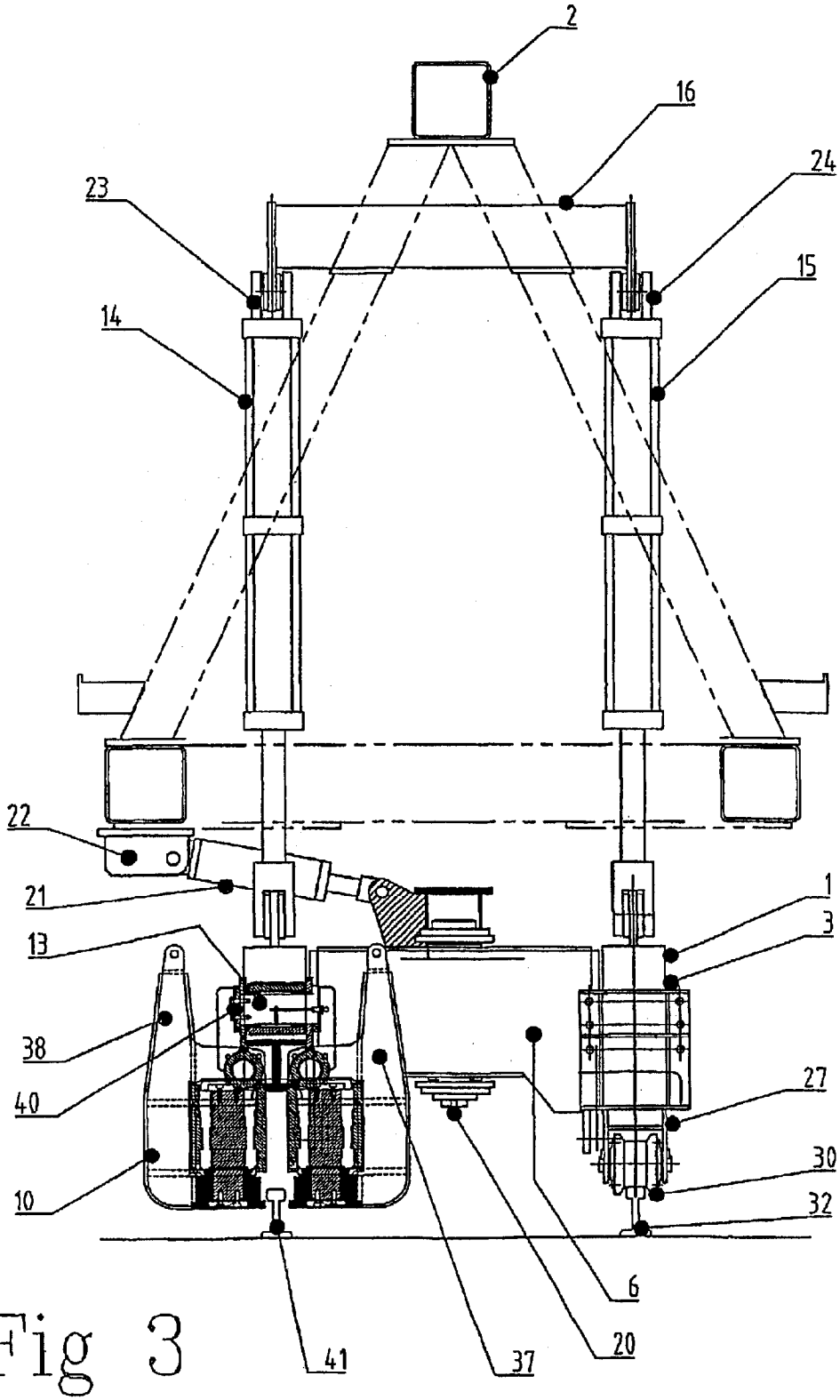
FIG. 3 is an end elevation of the roller rail clamp of the earlier figures with a portion of the drawing in cross-section at III—III of FIG. 2.

In FIGS. 1 to 3 there is shown roller rail clamp 1 mounted between railway wagon 2 only portion of which is shown in these figures (the wagon has been omitted from FIG. 2 for clarity). It will be appreciated that the wagon includes other components such as bogies at each end thereof and couplings. Equipment such as a system for operating hydraulic rams for operation of the rail clamp is also associated with the wagon.

Roller rail clamp 1 comprises lifting beams 3 and 4, drawbar 5 which is linked to the lifting beams by crosspiece 6, and lift roller assemblies 7 to 10. Drawbar 5 is connected to wagon 2 at 11 in such a manner that the drawbar can pivot in a vertical and horizontal plane with respect to the wagon. The ends of crosspiece 6 are journalled to the lifting beams at 12 and 13 which allows the pivoting of the lifting beams. Consequently, the vertical position of lifting beams 3 and 4 can be adjusted as can the tilt of the lifting beams. The adjustment of the vertical position of the lifting beams is effected by hydraulic lift rams 14 and 15 connected to a crosspiece 16. The tilt of each lifting beam is independently controlled by hydraulic rams that act between arms extending from the lifting beam and crosspiece 6. Such a tilt ram for lifting beam 4 is indicated at 17 of FIG. 1 where it acts between arms 18 and 19. It will be appreciated that a similar assembly is associated with lift beam 3.

Drawbar 5 in addition to being pivotally connected to wagon 2 is also pivotally connected to crosspiece 6 at 20. This allows lateral movement of the rail clamp with respect to the wagon. The lateral displacement of the lifting beams, and hence the lift roller assemblies, is regulated by an hydraulic ram 21 acting between drawbar 5 and an anchor point 22 on wagon 2. The lateral offset of the lifting beams is limited to about 200 mm. Coupling of lift rams 14 and 15 to crosspiece 16 at the ends 23 and 24 thereof is such that some lateral moment is permitted.

The ability to laterally displace the lifting beams of the rail clamp allows compensation for displacement of the track relative to the centre line of the wagon such as will occur when the wagon is travelling through a curve of small radius.

At each end of lifting beams 3 and 4 of roller rail clamp 1 there is fitted a height adjustable guide roller—see items 25 and 26 of FIG. 1 and item 27 of FIG. 3. The rollers, 28 to 30, respectively, of these guide rollers contact the running surfaces of the rails and thus help to maintain the rail heads in the grooves of the rollers of the lift roller assemblies (see below). The contact between the rollers 28 and 29 and the running surface of a rail can be appreciated from FIG. 1 where line 31 represents the running surface. It can be further appreciated from FIG. 3 that rollers are flanged (see item 30) to maintain the guide roller on rail 32.

The function of the guide rollers is to maintain the rollers of the lift roller assemblies in proper contact with the rail head. Depending on the settings of the lift roller assemblies, the lift roller flanges can move downwardly from snug under the rail head through contact between the roller rims and the head of the rail. This is particularly the case with track consisting of lighter rail material (for example, 41 kg/m rail).

With regard to the lift roller assemblies, one will now be described with reference to the assembly identified as item 10 in FIGS. 1 to 3. However, the features of lift roller assembly 10 are identical to the other assemblies of roller rail clamp 1.

Lift roller assembly 10 comprises two pairs of rollers 33 and 35, and 34 and 36, respectively (see FIG. 2 in particular), mounted to inner and outer clamp arms, 37 and 38 respectively. The mounting of the rollers to the clamp arms is such that vertical pivoting is possible. This allows individual opening and closing of rollers within a roller pair for crossing small obstacles. Inner and outer clamp arms 37 and 38 are in turn pivotally mounted to an upper carrier 39. Pivoting of upper carrier 39 is about a horizontal axis to allow for opening and closing of the lift rollers around the rail head. Upper carrier 39 is in turn pivotally mounted to lifting beam 4 through a journal at 40. This pivotal mounting allows adjustment of the angle of the lift roller assembly as a whole with respect to the rail to which it is clamped.

The rollers of the lift roller assemblies are set to be at a slight angle to the support member. This can be appreciated from the elevational view of lift roller assembly 10 in FIG. 1. The angling is by no more than several degrees but this aids passage of a rail through the rollers and the clamping action as required, the movement of roller rail clamp 1 of FIG. 1 with respect to the track being from right to left.

It can be appreciated from the partial cross-section of lift roller assembly 10 in FIG. 3 that when the assembly is clamped to rail 41, rail head 42 is retained in a cavity formed by the rims and flanges of the opposed rollers. This can be appreciated from the enlarged cross-section presented in FIG. 4 which also gives internal detail of the rollers. For clarity, only rollers 34 and 36, and rail 41 are shown in this figure.

Figure 4:
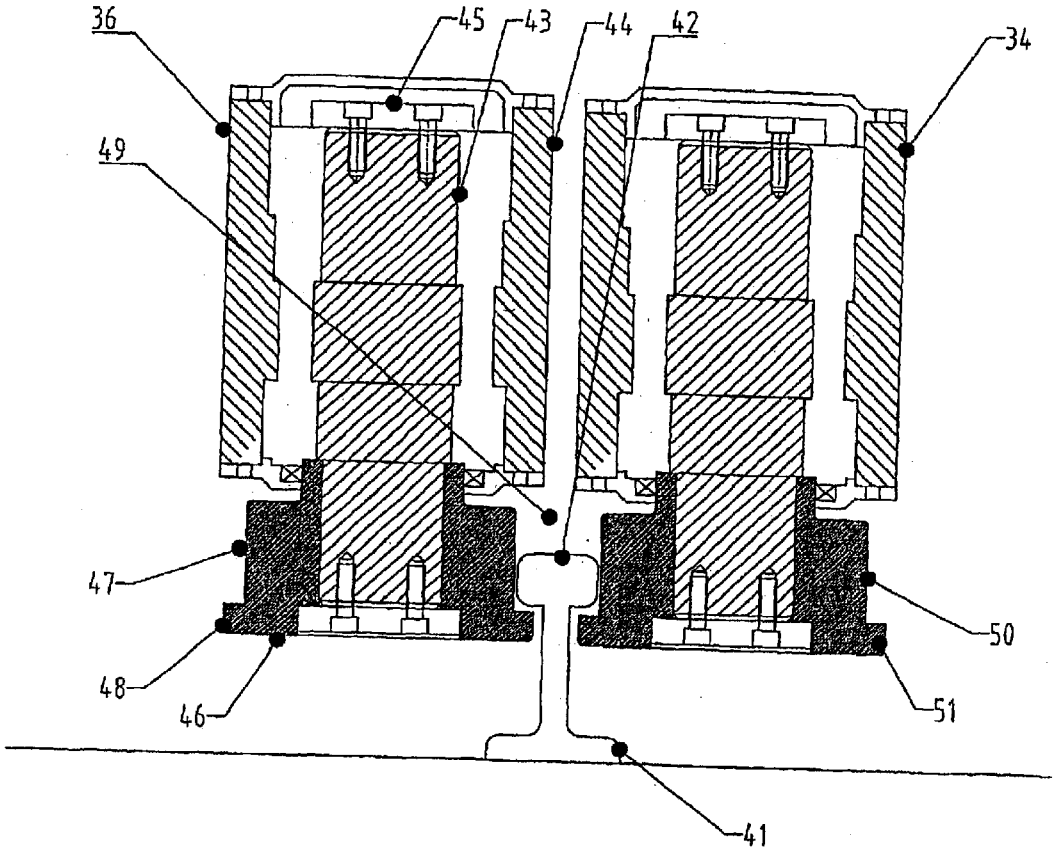
FIG. 4 is detailed view of the cross-section through the rollers at III—III of FIG. 2.

With reference to roller 36 as shown in FIG. 4, this can be seen to comprise a shaft 43 which is retained within a housing 44 by a bearing plate 45. Additional bearings are provided to handle lateral loading on the shaft, which bearings have been omitted from the drawing for clarity. A lower portion of shaft 43 extends beyond housing 44 and has fitted thereto a sleeve 46 which is machined to provide a roller rim 47 and a flange 48. With rollers 34 and 36 in the clamping position, head 42 of rail 41 is captive within a cavity 49 formed by rims 47 and 50, and flanges 48 and 51, of rollers 34 and 36, respectively.

It can be appreciated from FIG. 4 that engagement of rail head 42 by rollers 34 and 36 is via rims 47 and 50 which contact the sides of the head. The high clamp squeeze force applied by the rollers—in the exemplified case hydraulically—allows lifting of the rail by the apparatus. However, as a back-up to the primary roller engagement as described above, flanges 48 and 51 can contact the lower edges of rail head 42.

Figure 5A:
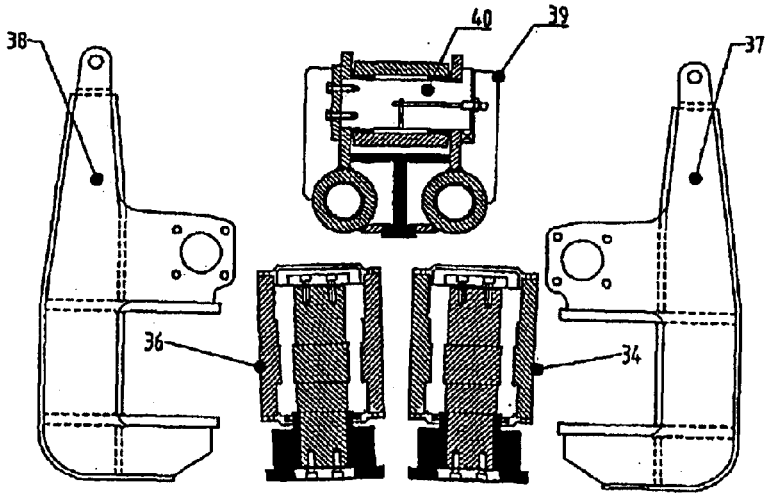
FIGS. 5A to 5C are end elevations of the same roller rail clamp assembly shown in FIG. 3 with a similar cross-section through the pair of rollers closest the viewer. The assembly components are exploded in FIG. 5A.
Figure 5B:
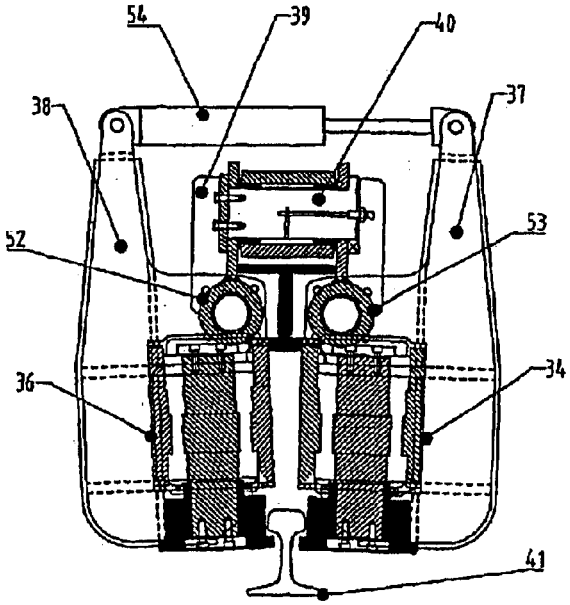
Figure 5C:
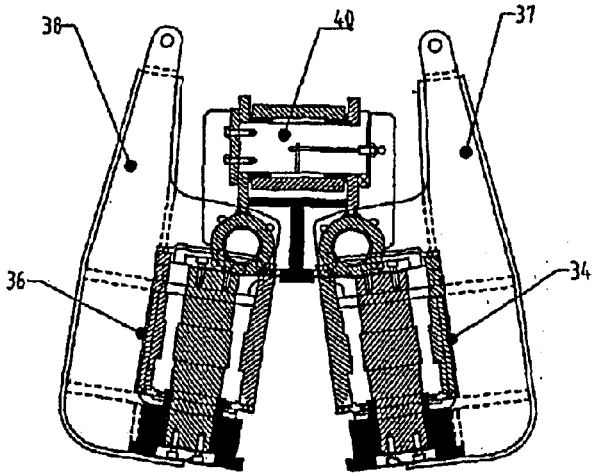

Lift roller assembly 10 is shown in greater detail in FIGS. 5A to 5C where rollers 34 and 36, clamp arms 37 and 38, upper carrier 39, and pivot point 40 can be seen. The pivoting of clamp arms 37 and 38 with respect to upper carrier 39 is at horizontal pin joints, the ends of which are items 52 and 53, respectively, of FIG. 5B. Clamp arms 37 and 38 are powered by a single hydraulic cylinder 54 connecting the upper ends of the arms which serves to open and close the two roller pairs of the assembly. The rollers are shown in the closed position about rail 41 in FIG. 5B and open in FIG. 5C (rail 41 and hydraulic cylinder 54 have been omitted from the latter figure for clarity). As indicated above, the rollers 34 and 36 are connected to the clamp arms by near vertical pivots (not shown in the figures). With reference to roller 34, the vertical pivot is positioned midway between roller 33 (see FIG. 2) and roller 34, which rollers are joined by a frame that houses the pivot. The pivot connects the rollers to the clamp arm 37. It will be appreciated that rollers 35 and 36 have the same vertical pivot arrangement as rollers 33 and 34. The vertical pivots allow the rollers of one lift roller assembly to open and close around a small obstacle such as a weld flashing while the rollers of the other pair of the assembly remain fully clamped. Upper carrier 39 is pivotally connected to the lift beam, item 4 of FIGS. 1 to 3, by a near horizontal pin at 40. It will be appreciated that there is considerable scope for adjustment of angles and positioning of the assembly because of these pivots. The degree of load sharing between the roller pairs of lift roller assembly 10 can thus be varied by adjustment of a constraint applied to the motion of the assembly about pin 40. This enables the angle of the rollers to be set to actual operating conditions.

The lift roller assemblies on each of lifting beams 3 and 4 are 2.0 m apart measured from pivot point to pivot point of the support members. The pairs of rollers of each assembly are 500 mm apart at their axes. Each roller has a diameter of 230 mm at the flange. The exemplified roller rail clamp is suitable for lifting track comprising 41 to 60 kg/m rails and can be used in machines which operate at up to about 12 km/hr.

Operation of the roller rail clamp, and additional features of the device, will now be given with reference to FIGS. 6A to 6F. For clarity the track—or more specifically a rail thereof—on which the roller rail clamp is operating is represented as a single line below the clamp. In actual operation, the rail would of course pass through the roller assemblies. For illustrative purposes, a fishplate constitutes the obstruction. This is represented as a filled box in the line representing the rail. The working direction of the machine carrying the roller rail clamp is from right to left.

Figure 6A:
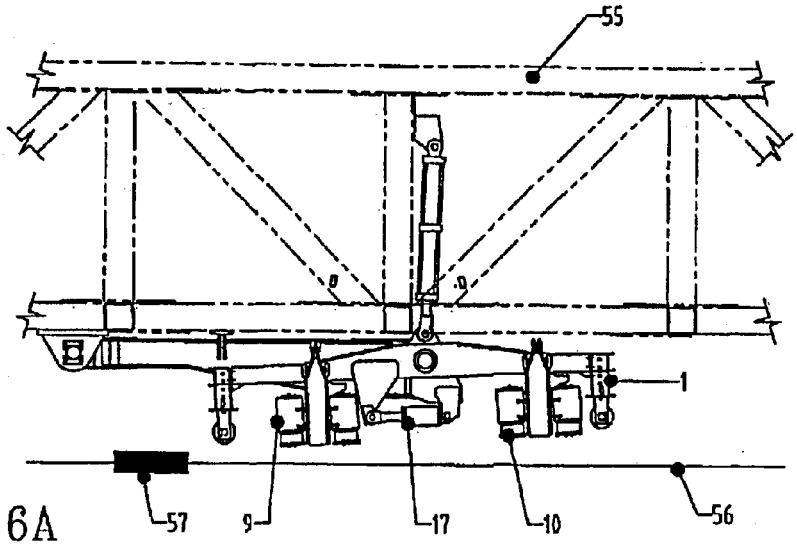
FIGS. 6A to 6F depict the operation of the roller rail clamp of the invention.

In FIG. 6A, there is shown roller rail clamp 1 in the normal working position—that is, clamped to a section of track with the track elevated—beneath a machine 55 only portion of which is shown in the figure. As rail clamp 1 is in the normal position, trailing lift roller assembly 10 is higher than leading lift roller assembly 9 due to tilting of the lifting beams under the action of hydraulic ram 17 of the tilt mechanism. Lift roller assembly 10 is thus load bearing. Leading lift roller assembly 9 is nevertheless clamped to a rail of the track on which machine 55 is operating, which rail is represented by line 56. The rail clamp is approaching a fishplate 57 in the rail.

Figure 6B:
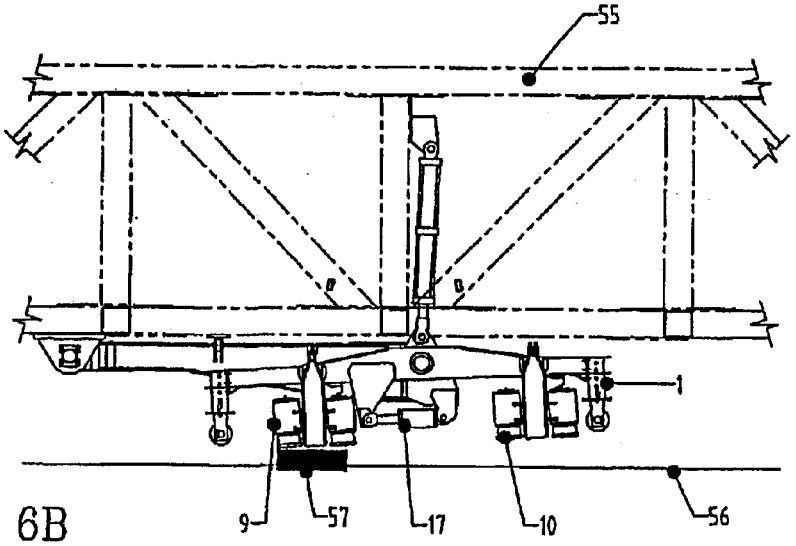
Figure 6C:
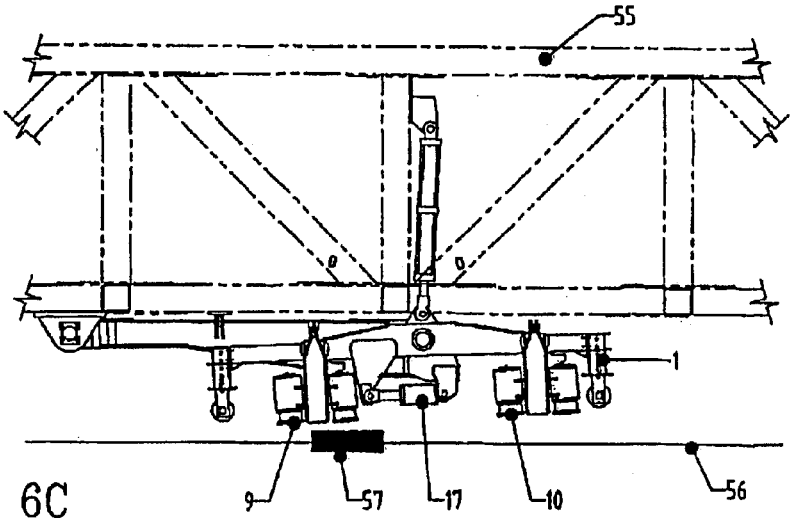

In FIG. 6B, the leading lift roller assembly 9 has contacted fishplate 57 effecting opening of the rollers so that the assembly can traverse the fishplate. The track is still suspended, however, being held by the trailing lift roller assembly 10.

A sensor in lift roller assembly 9 detects opening and subsequent closing of the rollers as they pass over fishplate 57. Upon sensing the opening of roller assembly 9, the control program takes no external action but prepares to respond with a tilt rear when it senses that roller assembly 9 has cleared the fishplate. Note that in FIG. 6C the fishplate 57 is partially clear of roller assembly 9. No action is taken at this stage other than readiness for the full closing of roller assembly 9 when it is fully clear of the fishplate.

Figure 6D:
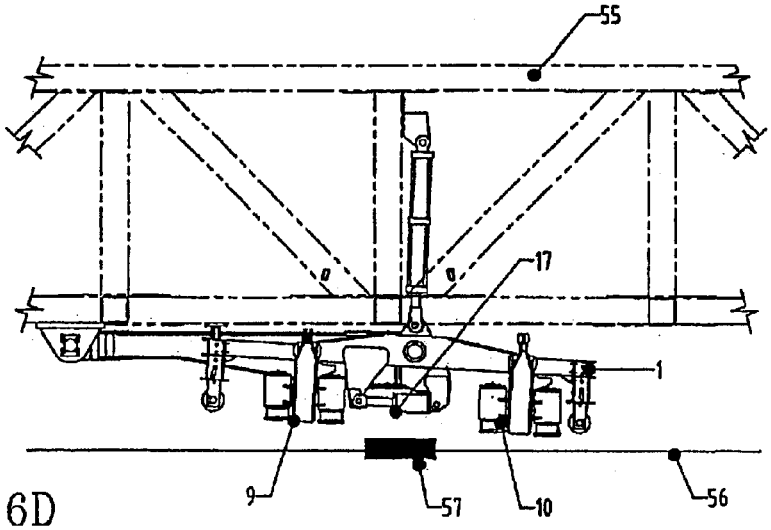

Upon sensing that roller assembly 9 has fully closed after passing over fishplate 57, a programmable logic control circuit actuates hydraulic ram 17 of the tilt mechanism to tilt the lifting beams so that leading lift roller assembly 9 is higher than trailing assembly 10 as shown in FIG. 6D. This transfers the load to lift roller assembly 9. At this stage, the fishplate obstruction 57 is between lift roller assemblies 9 and 10.

Figure 6E:
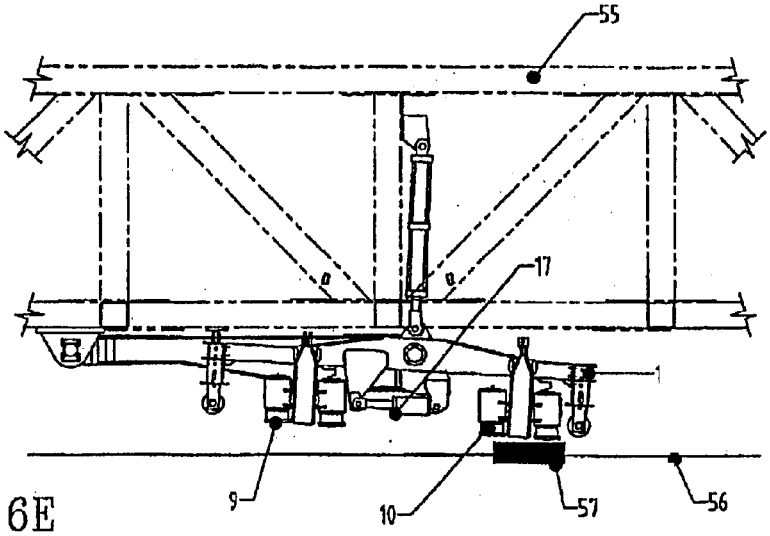

In FIG. 6E, trailing lift roller assembly 10 has contacted fishplate 53 effecting opening of the rollers so that the assembly can traverse the obstruction. As in FIG. 6B, despite opening of the rollers of one of the lift roller assemblies, the track remains suspended being retained by the now load bearing leading lift roller assembly 9.

Figure 6F:
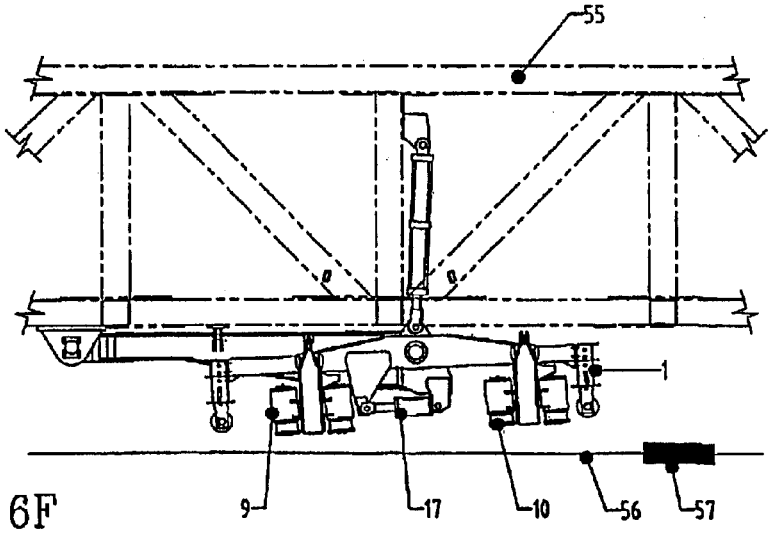

In FIG. 6F, after traversing fishplate 53, closing of the rollers of lift roller assembly 10 is sensed, hydraulic ram 17 is activated, and the lifting beams are tilted to return the trailing lift roller assembly to a higher, and load bearing, position as shown in FIG. 6A. This is the normal working position with the roller rail clamp ready to traverse the next obstacle.

In the preceding illustration, reference has only been made to the lift roller assemblies visible in the drawings. It will be appreciated that the sequence of events described above applies to the lift roller assemblies on the lifting beam behind the visible lifting beam. Furthermore, each lifting beam has its own tilt cylinder so that the lifting beams operate independently over fishplates and other obstacles.

It will be appreciated that many changes can be made to the roller lift clamp and use thereof as exemplified above without departing from the broad ambit and scope of the invention.

The term "comprise", or variants thereof such as "comprising" or "comprised", is used herein to denote the inclusion of a stated integer or integers, unless is the context of usage an exclusive interpretation of the term is required.

What is claimed is:

1. Roller rail clamp apparatus for use with track comprising a pair of parallel rails, said apparatus comprising:

parallel pairs of spaced-apart lift roller assemblies mounted to a support for positioning a pair of assemblies for clamping to one of the rails of said track, each said lift roller assembly comprising at least one pair of rollers, wherein each roller of the pair of rollers rotates on an axis in an essentially vertical plane adjacent one of the rails and said rollers are on opposite sides of one of the rails when the lift roller assemblies are clamped thereto with the head of said rail releasably retained between said rollers;

means for adjustably connecting said apparatus to a carrier thereof;

a lift mechanism for adjusting the vertical position of said support relative to said carrier of said apparatus; and a tilt mechanism for applying torque about a horizontal axis to linkage between members of the pair of lift roller assemblies for transferring load bearing from one said lift roller assembly to the other said lift roller assembly wherein load transfer from the load-bearing lift roller assembly occurs after opening and subsequent closing of the other one of the lift roller assemblies.

2. The apparatus according to claim 1, wherein said support for said lift roller assemblies comprises a longitudinal beam for each pair of assemblies, the longitudinal beams being spaced apart by a cross-piece to which said beams are pivotally mounted.

3. The apparatus according to claim 2, further comprising a height-adjustable guide roller at each end of said beam which in use contacts the running surface of said rail.

4. The apparatus according to claim 1, wherein said means for adjustably connecting said apparatus to a carrier therefor is a series of vertical and horizontal slides, a drawbar, a push bar, or a parallelogram linkage.

5. The apparatus according to claim 1, wherein said lift and tilt mechanisms comprise or hydraulic rams.

6. The apparatus according to claim 1, wherein said means for adjustably connecting said apparatus to said carrier comprises a drawbar, and said lift and tilt mechanisms comprise hydraulic rams.

7. The apparatus according to claim 1, wherein a mechanism is provided for lateral adjustment of said apparatus relative to said carrier.

8. The apparatus according to claim 7, wherein said mechanism comprises at least one hydraulic ram extending between said carrier and said support for said lift roller assemblies.

9. The apparatus according to claim 1, wherein said carrier is a wagon, excavator, crane or gantry.

10. The apparatus according to claim 1, wherein each lift roller assembly comprises two pairs of spaced apart rollers.

11. The apparatus according to claim 10, wherein inner and outer rollers of said pairs are pivotally mounted, respectively, to inner and outer clamp arms, wherein said pivotal mounting allows opening and closing of the pair of rollers.

12. The apparatus according to claim 11, wherein said inner and outer clamp arms are pivotally mounted to a carrier therefor, wherein said pivotal mounting allows opening and closing of the pair of said lift roller assembly.

13. The apparatus according to claim 12, wherein said clamp arm carrier is pivotably mounted to said support to allow adjustment of the angle of said lift roller assembly comprising said roller pairs.

14. The apparatus according to claim 1, wherein each said roller is flanged at its distal end.

15. The apparatus according to claim 1, wherein each said roller of a pair of rollers comprises a shaft retained within a housing by a bearing plate at the upper end of said shaft, and wherein the lower end of said shaft extends out of said housing and has fitted thereto a sleeve which is machined to provide a roller rim.

16. The apparatus according to claim 15, wherein said sleeve is further machined to provide a distal flange.

17. The apparatus according to claim 1, wherein lift roller assemblies include sensors to detect opening and closing of the at least one pair of rollers.

18. The apparatus according to claim 1, wherein a programable logic control circuit is provided to control tilting of said support for a pair of lift roller assemblies to transfer load bearing between leading and trailing assemblies.

19. The apparatus according to claim 1, wherein said rollers of said pair are non self-locking.

20. Roller rail clamp apparatus for use with track comprising a pair of parallel rails, said apparatus comprising:

parallel pairs of spaced-apart lift roller assemblies pivotably mounted to a beam for positioning a pair of assemblies for clamping to one of the rails of said track, said beam of each pair of assemblies being pivotally connected to a crosspiece and said lift roller assemblies comprising two spaced apart pairs of rollers, wherein each roller of the pair of rollers rotates on an axis in an essentially vertical plane adjacent one of the rails and said rollers are on opposite sides of a rail when the lift roller assemblies are clamped thereto with the head of said rail releasably retained upwardly of flanges at the lower ends of said rollers, and wherein said pair of rollers is non self-locking to allow opening thereof on contacting an obstacle;

a drawbar for adjustably connecting said apparatus to a wagon with which said apparatus is associated;

an hydraulic ram extending between said wagon and each said beam for adjusting the vertical position of said beam relative to said wagon; and an hydraulic ram extending between said crosspiece and said beam for applying torque about a horizontal axis relative to said beam for transferring load bearing from one said lift roller assembly to the other said lift roller assembly, wherein load transfer from the load-bearing lift roller assembly occurs after opening and subsequent closing of the other one of the lift roller assemblies.

* * * * *